United States Patent [19]

Yoshida et al.

[11] Patent Number: 4,714,794

[45] Date of Patent: Dec. 22, 1987

[54] SYNTHETIC OILS

[75] Inventors: Toshio Yoshida, Kawasaki; Harumichi Watanabe, Yokohama, both of Japan

[73] Assignee: Nippon Oil Co., Ltd., Nishishimbashi, Japan

[21] Appl. No.: 50,760

[22] Filed: May 15, 1987

Related U.S. Application Data

[63] Continuation of Ser. No. 799,405, Nov. 19, 1985, abandoned.

[30] Foreign Application Priority Data

Nov. 28, 1984 [JP] Japan ..... 59-249771
Nov. 28, 1984 [JP] Japan ..... 59-249773

[51] Int. Cl.[4] ..... C07C 2/58; C07C 15/24

[52] U.S. Cl. ..... 585/26; 585/13; 585/454; 585/455; 585/459; 252/73

[58] Field of Search ..... 252/73, 56 S; 585/24, 585/25, 26, 454, 455, 456, 459, 7, 13

[56] References Cited

U.S. PATENT DOCUMENTS

| | | | |
|---|---|---|---|
| 2,866,142 | 12/1958 | Cook et al. | 585/26 |
| 3,563,673 | 2/1971 | Sakuma | 585/26 |
| 3,598,739 | 8/1971 | Sias | 585/26 |
| 4,275,253 | 6/1981 | Takahashi et al. | 585/26 |
| 4,282,354 | 8/1981 | Van Allen et al. | 585/26 |
| 4,368,343 | 1/1983 | Kotlyarevsky et al. | 585/26 |
| 4,506,107 | 3/1985 | Sato et al. | 585/26 |
| 4,604,491 | 8/1986 | Dressler et al. | 585/26 |
| 4,665,275 | 5/1987 | Yoshida et al. | 585/26 |

FOREIGN PATENT DOCUMENTS

| | | | |
|---|---|---|---|
| 1274097 | 8/1968 | Fed. Rep. of Germany | 585/26 |
| 635122 | 12/1976 | U.S.S.R. | 585/26 |

*Primary Examiner*—Asok Pal
*Attorney, Agent, or Firm*—Bucknam and Archer

[57] ABSTRACT

A synthetic oil having excellent oxidation stability, comprising a mixture of monoalkylnaphthalenes which have each a secondary alkyl group of 6 to 24 carbon atoms and in which the specific molar ratio of $\alpha$- to $\beta$-substituted monalkylnaphthalenes is at least 1.0. The synthetic oil is useful as a thermal medium oil or as the main component of a synthetic lubricating oil.

12 Claims, No Drawings

SYNTHETIC OILS

This is a continuation of application Ser. No. 799,405 filed Nov. 19, 1985, now abandoned.

BACKGROUND OF THE INVENTION

1. Field of the Invention

This invention relates to a novel synthetic oil for use as a thermal medium oil having excellent oxidation stability or for use as the main component for a synthetic lubricating oil having excellent oxidation stability. More particularly, it relates to such a novel synthetic oil which consists of, or comprises as the main component, a mixture of monoalkylnaphthalenes having a specific structure.

2. Prior art

With the recent remarkable progress in the chemical industry, an indirect heating system using an oil or the like therein as the thermal medium has been widely used, instead of a direct heating system, in all the fields of fiber, paper, foodstuff, architecture, chemical and like industries.

A thermal medium oil has most generally been used as the thermal medium in the indirect heating system and is required to have the following properties:

(1) excellent thermal stability
(2) low vapor pressure and high flash point
(3) good fluidity at low temperatures
(4) nonpoisonousness and adorlessness
(5) high heating efficiency As such thermal medium oils, there are now widely used, for example, not only antioxidantincorporated highly refined mineral oils but also phenyl ethers, polyphenyls, arylalkanes and alkylnaphthalenes having a methyl, ethyl, propyl or like group.

Among the above thermal medium oils, those of the alkylnaphthalene type preferably have favorable properties such as nonpoisonousness, a low viscosity, low melting point and high boiling point. However, they are still not satisfactory in stability to oxidation.

Lubricating oils are generally required to have a long term service life. To meet this requirement, there has usually been used a lubricating oil prepared by adding, as required , a suitable antioxidant to a highly refined mineral oil. It is difficult, however, to use a mineral oil as a lubricant for a long period of time under severe temperature conditions since the mineral oil has limited oxidation stability. Thus, as lubricating oils having better oxidation stability, there have been developed and widely used ester-type synthetic oils such as diesters and polyol esters, and hydrocarbon-type synthetic oils such as poly-α-olefins and alkylbenzenes.

However, although these known synthetic lubricating oils are appreciated to have higher oxidation stability than mineral oils, they are still not satisfactory in stability to oxidation.

The present inventors made intensive studies in attempts to develop synthetic oils having further higher oxidation stability which are satisfactory for use as a thermal medium oil or the main component of a synthetic lubricating oil and, as the result of their studies found that synthetic oils consisting of, or comprising as the main component, a mixture of monoalkylnaphthalenes having a specific structure, show remarkably high oxidation stability as compared with the conventional known systhetic oils. The synthetic oils so found may be used as a satisfactory synthetic lubricating oil or thermal medium oil.

This invention is based on this finding or discovery.

OBJECT OF THE INVENTION

An object of this invention is to provide synthetic oils which are excellent in oxidation stability and are satisfactory for use as a thermal medium oil or for use as the main component of a synthetic lubricating oil.

CONSTRUCTION OF THE INVENTION

The synthetic oil of this invention consists of, or comprises as the main component, mixed monoalkylnaphthalenes which have each a secondary alkyl group having 6 to 24 carbon atoms and in which the molar ratio of α- to β-substituted alkylnaphthalenes is at least 1.0.

This invention will be explained hereunder in more detail.

The mixture of alkylnaphthalenes which makes up, or is comprised as the main component in, the synthetic oil of this invention is required to be such that:

(1) The alkylnaphthalenes are each a mono- alkylnaphthalene.

(2) The number of carbon atoms of the alkyl group is 6 to 24.

(3) The alkyl group is a secondary alkyl group.

(4) The molar ratio of α- to β-substituted alkylnaphthalenes is at least 1.0.

The above four requirements must be met for the purpose of this invention. Alkylnaphthalene mixtures which fail to meet even one of said four requirements are undesirable since they are inferior to those used in this invention in the respects of oxidation stability and other physical properties necessary for the synthetic oils of this invention.

In the mixed monoalkylnaphthalenes of this invention, the number of carbon atoms of the secondary alkyl group in the monoalkylnaphthalene is 6 to 24 and preferably 8–14 in view of the physical characteristics of the resulting synthetic oil.

In the secondary alkyl group of the monoalkylnaphthalenes used in this invention, the two alkyl groups ($R_1$ and $R_2$, or $R_3$ and $R_4$ as indicated later) bonded to the secondary carbon of the naphthalene ring are each preferably a straight-chain alkyl group. Thus, the said monoalkylnaphthalene mixture may be represented by the following general formulae,

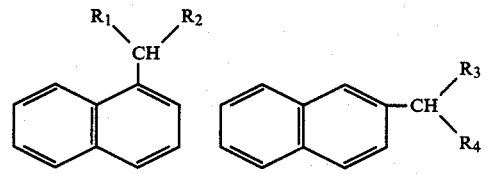

wherein $R_1$, $R_2$, $R_3$ and $R_4$ are each an alkyl group and the total of the carbon atoms in $R_1$ and $R_2$ or in $R_3$ and $R_4$ is 5 to 23. Further, it is preferable that $R_1$, $R_2$, $R_3$ and $R_4$ groups are each a straight-chain alkyl group.

The preferable secondary alkyl groups of the monoalkyl-naphthalene include 1-methylheptyl, 1-ethylhexyl, 1-propylpentyl, 1-methyloctyl, 1-ethylheptyl, 1-propylhexyl, 1-butylpentyl, 1-methylnonyl, 1-ethyloctyl, 1-propylheptyl, 1-butylhexyl, 1-methyldecyl, 1-ethylnonyl, 1-propyloctyl, 1-butylheptyl, 1-pentylhexyl, 1-methylundecyl, 1-ethyldecyl, 1-propylnonyl, 1-butyloctyl, 1-pentylheptyl, 1-methyldodecyl, 1-ethylundecyl, 1-propyldecyl, 1-butylnonyl, 1-pentyloctyl, 1-hexylheptyl, 1-methyltridecyl, 1-ethyldodecyl, 1-propylundecyl, 1-butyldecyl, 1-pentylnonyl, 1-hexyloctyl, 1-methyltetradecyl, 1-ethyltridecyl, 1-propyldodecyl, 1-butylundecyl, 1-pentyldecyl, 1-hexylnonyl, 1-heptyloctyl, 1-methylpentadecyl, 1-ethyltetradecyl, 1-propyltridecyl, 1-butyldodecyl, 1-pentylundecyl, 1-hexyldecyl, 1-heptylnonyl, 1-methylhexadecyl, 1-ethylpentadecyl, 1-propyltetradecyl, 1-butyltridecyl, 1-pentyldodecyl, 1-hexyundecyl, 1-heptyldecyl, 1-octylnonyl, 1-methylheptadecyl, 1-ethylhexadecyl, 1-propylpentadecyl, 1-butyltetradecyl, 1-pentyltridecyl, 1-hexyldodecyl, 1-heptylundecyl and 1-octyldecyl.

The mixture of monoalkylnaphthalenes of this invention may be obtained by mixing various kinds of monoalkylnaphthalenes together, and it may usually be synthesized in one step by Friedel-Crafts' alkylating reaction. The monoalkylnaphthalene is classified into an α-substituted one wherein the secondary alkyl group is substituted at the α-position of the naphthalene ring and a β-substituted one wherein the secondary alkyl group is substituted at the β-position of the ring. It is important that the molar ratio of α- to β-substituted alkylnaphthalenes in the mixture of this invention be at least 1.0, preferably 1.0 to 2.0. A monoalkylnaphthalene mixture having a molar ratio of less than 1.0 is unfavorable for use as the synthetic oil of this invention because of its poor stability to oxidation.

In the Friedel-Crafts' alkylating reaction to synthesize alkylnaphthalenes of this invention in one step, a primary or secondary alkyl halide, alcohol or a monoolefin each having 6 to 24 carbon atoms as the alkyl source, is reacted with naphthalene at a reaction temperature of 0°–250° C. in the presence of a metal halide catalyst such as aluminum chloride, zinc chloride or iron chloride, or an acid catalyst such as sulfuric acid, phosphoric acid, phoshorus pentoxide, fluoric acid, boron fluoride, acid clay or activated clay. As the alkyl source, a monoolefin having 6 to 24 carbon atoms is preferable since it is easily available. The monoolefin is more preferably a straight-chain one and the most preperably a straight-chain α-olefin.

By the said reaction of naphthalene and the alkyl source in the presence of an acid catalyst, due to the transfer of carbonic cation, there will be produced a mixture of α- and β-substituted monoalkylnaphthalenes having various secondary alkyl groups. The molar ratio of the α- to the β-substituted monoalkylnaphthalenes produced varies depending on the kinds of an alkyl source and catalyst used as well as on the reaction conditions such as the reaction temperature and reaction time used. The molar ratio used in this invention should be at least 1.0 in a case where the monoalkylnaphthalene mixture of this invention is attempted to be obtained by the one-step reaction.

The synthetic oils which is a mixture of monoalkylnaphthalenes of this invention are, per se, excellent particularly in oxidation stability and in other properties required in ordinary synthetic oils. In a case where they are attempted to be used as the main component of a synthetic lubricating oil, they may be incorporated, as required, with usually-used known additives for lubricating oils such as an antioxidant, detergent dispersion, viscosity index improver, pour point depressant, oiliness improver, anti-wear agent, extreme pressure agent, anticorrosive agent, metal inactivating agent, antirust agent, antifoaming agent, emulsifier, demulsifier, bactericide, colorant and/or the like.

In a case where the synthetic oils of this invention are attempted to be used as a thermal medium oil, they may be incorporated, as required, with usually-used known additives for heating medium oils such as an antioxidant, antifoaming agent, detergent dispersion, antirust agent, pour point adepressant and/or the like.

The various additives mentioned above are described in detail in publications such as "Junkatsuyu Gakkai Shi (Journal of Japanese Society of Lubricating Oils)", vol. 15, No. 6 or "Sekiyu Seihin Tenkazai (Additives for Petroleum Products)" edited by Toshio Sakurai and published by Sachi Shobo Book Store.

Further, the synthetic lubricating oils of this invention may be incorporated, as required, with mineral oils and/or known lubricating oils in such amounts as not to impair their high oxidation stability. The mineral oils and/or known lubricating oils may be added in an amount by weight of up to 75%, preferably up to 50%, more preferably up to 25%.

The synthetic lubricating oils comprising, as the main component, a mixture of monoalkylnaphthalenes of this invention can be used as gasoline engine oils, diesel engine oils, turbine oils, gear oils, hydraulic working oils, compressor oils, refrigerator oils, metal working oils, slip guide surface oils, bearing oils and the like.

PREFERRED EMBODIMENTS

This invention will be better understood by the following Examples and Comparative Examples.

EXAMPLE 1

Naphthalene and decene-1 were reacted together in the presence of activated clay as the catalyst thereby to obtain a $C_{10}$-monoalkylnaphthalene mixture (I) wherein the molar ratio of α- to β-substituted alkylnaphthalenes was 1.33. The composition and properties of the product were as follows:

| (Composition) | |
|---|---|
| α-(1-methylnonyl) naphthalene, | 19 mol % |
| α-(1-ethyloctyl) naphthalene, | 16 mol % |
| α-(1-propylheptyl) naphthalene, | 12 mol % |
| α-(1-butylhexyl) naphthalene, | 10 mol % |
| Total amount of α-substituted alkylnaphthalenes: | 57 mol % |
| β-(1-methylnonyl) naphthalene, | 12 mol % |
| β-(1-ethyloctyl) naphthalene, | 11 mol % |
| β-(1-propylheptyl) naphthalene, | 10 mol % |
| β-(1-butylhexyl) naphthalene, | 10 mol % |
| Total amount of -substituted alkylnaphthalenes: | 43 mol % |

Properties

Viscosity: 11.93 cSt at 40° C.

Pour point: ≦−45° C.

Boiling point: 160°–170° C. at 1 mmHg

To evaluate the oxidation stability of the thus obtained $C_{10}$-monoalkylnaphthalene mixture (I), a high-temperature oxidation test was made using a test equipment prescribed in IP-280, under the following test conditions:

Test temperature: 170° C.

Flow of oxygen: 3l/hr

Catalyst: Copper wire 1 mm ϕ80 cm.

In the evaluation test, the oxidation stability was expressed as a time (specifically, an oxidation test lifetime) for the test oil to reach 1.0 mg KOH/g in acid value. The test results are as shown in Table 1.

EXAMPLE 2

The procedure of Example 1 was followed except that 1-octane was substituted for the decene-1, thereby to obtain a $C_8$-monoalkylnaphthalene mixture (I) wherein the molar ratio of α- to β-substituted alkylnaphthalenes was 1.44. The composition and properties of the thus obtained product were as follows:

| (Composition) | |
|---|---|
| α-(1-methylheptyl) naphthalene, | 29 mol % |
| α-(1-ethylhexyl) naphthalene, | 17 mol % |
| α-(1-propylpentyl) naphthalene, | 13 mol % |
| Total amount of α-substituted alkylnaphthalenes: | 59 mol % |
| β-(1-methylheptyl) naphthalene, | 17 mol % |
| β-(1-ethylhexyl) naphthalene, | 12 mol % |
| β-(1-propylpentyl) naphthalene, | 12 mol % |
| Total amount of β-substituted alkylnaphthalenes: | 41 mol % |

Properties

Viscosity: 10.54 cSt at 41° C.
Pour point: ≦−45° C.
Boiling point: 140°–150° C. at 1 mmHg The oxidation stability of the thus obtained product was evaluated by the same test as made in Example 1. The test results are as indicated in Table 1.

EXAMPLE 3

The procedure of Example 1 was followed except that hexadecene-1 was substituted for the decene-1, thereby to obtain a $C_{16}$-monoalkylnaphthalene mixture (I). The molar ratio of α-to β-substituted alkylnaphthalenes in this product was 1.63. The composition and properties of the product were as follows:

| (Composition) | |
|---|---|
| α-(1-methylpentadecyl) naphthalene, | 18 mol % |
| α-(1-ethyltetradecyl) naphthalene, | 10 mol % |
| α-(1-propyltridecyl) naphthalene, | 7 mol % |
| α-(1-butyldodecyl) naphthalene, | 5 mol % |
| α-(1-pentylundecyl) naphthalene, α-(1-hexyldecyl) naphthalene, α-(1-heptylnonyl) naphthalene, | 22 mol % |
| Total amount of α-substituted alkylnaphthalenes: | 62 mol % |
| β-(1-methylpentadecyl) naphthalene, | 12 mol % |
| β-(1-ethyltetradecyl) naphthalene, | 7 mol % |
| β-(1-propyltridecyl) naphthalene, | 4 mol % |
| β-(1-butyldodecyl) naphthalene, | 2 mol % |
| β-(1-pentylundecyl) naphthalene, β-(1-hexyldecyl) naphthalene, β-(1-heptylnonyl) naphthalene, | 13 mol % |
| Total amount of β-substituted alkylnaphthalenes: | 38 mol % |

Properties

Viscosity: 27.03 cSt at 40° C.
Pour point: ≦−45° C.
Boiling point: 214°–224° C. at 1 mmHg The oxidation stability was evaluated by the same test as made in Example 1 with the results being as shown in Table 1.

Comparative Examples 1–4

A decene-1 oligomer having an average molecular weight of about 500 (Comparative Example 1), dioctyl sebacate (Comparative Example 2), pentaerithritol tetracapriate (Comparative Example 3) and diisopropylnaphthalene (Comparative Example 4), were used for comparison with the monoalkylnaphthalene mixtures of this invention (Examples 1–3). The oxidation stability was evaluated in the same manner as in Example 1. The results are as shown in Table 1.

Comparative Examples 5–6

A refined mineral oil of naphthene origin, known as a thermal medium oil, incorporated with 1.0 weight % of 2, 6-di-t.-butyl-4-methylphenol (Comparative Example 5) and a diisopropylnaphthalene (Comparative Example 6) were evaluated for their oxidation stability by the same test as carried out in Example 1. The test results are as shown in Table 1.

Comparative Example 7

The procedure of Example 1 was followed except that the reaction conditions were varied, thereby to obtain a $C_{10}$-monoalkylnaphthalene mixture (II) wherein the molar ratio of α-to β-substituted alkylnaphthalenes was 0.61. The composition and properties of the thus obtained product were as follows:

| (Composition) | |
|---|---|
| α-(1-methylnonyl) naphthalene, | 13 mol % |
| α-(1-ethyloctyl) naphthalene, | 11 mol % |
| α-(1-propylheptyl) naphthalene, | 8 mol % |
| α-(1-butylhexyl) naphthalene, | 6 mol % |
| Total amount of α-substituted alkylnaphthalenes: | 38 mol % |
| β-(1-methylnonyl) naphthalene, | 22 mol % |
| β-(1-ethyloctyl) naphthalene, | 16 mol % |
| β-(1-propylheptyl) naphthalene, | 10 mol % |
| β-(1-butylhexyl) naphthalene, | 14 mol % |
| Total amount of β-substituted alkylnaphthalenes: | 62 mol % |

Comparitive Example 8

The procedure of Example 2 was followed except that the reaction conditions were varied, thereby to obtain a $C_8$-monoalkylnaphthalene mixture (II) wherein the molar ratio of α- to β-substituted alkylnaphthalenes was 0.28. The composition and properties of the thus obtained product were as follows:

| (Composition) | |
|---|---|
| α-(1-methylheptyl) naphthalene, | 10 mol % |
| α-(1-ethylhexyl) naphthalene, | 7 mol % |
| α-(1-propylpentyl) naphthalene, | 5 mol % |
| Total amount of α-substituted alkylnaphthalenes: | 22 mol % |
| β-(1-methylheptyl) naphthalene, | 42 mol % |
| β-(1-ethylhexyl) naphthalene, | 20 mol % |
| β-(1-propylpentyl) naphthalene, | 16 mol % |
| Total amount of β-substituted alkylnaphthalenes: | 78 mol % |

Experiments (Oxidation tests on the end products of Examples 1–3 and Comparative Examples 1–8)

The end products of Examples 1–3 and Comparative Examples 1–8 were evaluated for their oxidation stability as mentioned before.

As previously stated, the evaluation for oxidation stability was made by measuring how long each of the test compounds took to reach 1.0 mg KOH/g in acid value. The time so taken was assumed to be a service life at oxidation test. The results are as indicated in Table 1.

TABLE 1

| | Test product | Service life at oxidation test, (hr) |
|---|---|---|
| Ex.1 | $C_{10}$—monoalkylnaphthalene mixture (I) | 75.0 |
| Ex. 2 | $C_8$—monoalkylnaphthalene mixture (I) | 88.0 |
| Ex. 3 | $C_{16}$—monoalkylnaphthalene mixture (I) | 65.0 |
| Comp. Ex. 1 | Decene-1 oligomer (Av. Mol. Wt., about 500) | 2.8 |
| Comp. Ex. 2 | Dioctyl sebacate | 2.8 |
| Comp. Ex. 3 | Pentaerithritol tetracapriate | 3.0 |
| Comp. Ex. 4 | Diisopropylnaphthalene | 2.0 |
| Comp. Ex. 5 | Refined mineral oil of naphthene origin*1 | 8.0 |
| Comp. Ex. 6 | Diisopropylnaphthalene | 2.0 |
| Comp. Ex. 7 | $C_{10}$—monoalkylnaphthalene mixture (II) | 18.0 |
| Comp. Ex. 8 | $C_8$—monoalkylnaphthalene mixture (II) | 15.0 |

*1 1.0 wt. % of 2, 6-di-t.-butyl-4-metylphenol was added.

It is apparent from the results (service life at oxidation test) that the synthetic oils comprising the monoalkylnaphthalenes of this invention have very high oxidation stability, whereas the poly-α-olefin, diester, polyester, alkylnaphtalene and the like which have heretofore been considered to have excellent oxidation stability, are very infereior in said service life to the synthetic oils of this invention.

As is seen from the foregoing, a mixture of monoalkylnaphthalenes having a molar ratio of less than 1.0 is also inferior in service life to the monoalkylnaphthalene mixture of this invention.

What is claimed is:

1. A method of lubrication which consists of applying to the structure to be lubricated a synthetic oil which comprises as the active ingredient a mixture of monoalkylnaphthalenes represented by the following general formulae,

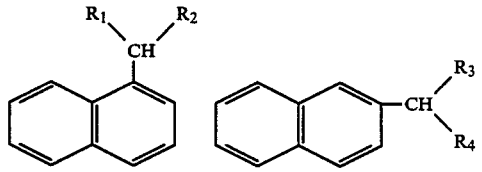

Wherein $R_1$, $R_2$, $R_3$ and $R_4$ are each a straight-chain alkyl group and the total of the carbon atoms in $R_1$ and $R_2$ or in $R_3$ and $R_4$ is 5 to 23, and the molar ratio of α-substituted monoalkylnaphthalenes to β-substituted monoalkylnaphthalenes being at least 1.0.

2. A method according to claim 1, wherein the said molar ratio is 1.0 to 2.0.

3. A method according to claim 1, wherein said total of the carbon atoms in $R_1$ and $R_2$ or in $R_3$ and $R_4$ in 7 to 13.

4. A lubricating oil composition containing as the active ingredient a mixture of monoalkylnaphthalenes represented by the following general formulae,

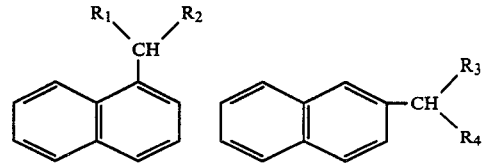

wherein $R_1$, $R_2$, $R_3$ and $R_4$ are each a straight-chain alkyl group and the total of the carbon atoms in $R_1$ and $R_2$ or in $R_3$ and R4 is 5 to 23, and the molar ratio of α-substituted monoalkylnaphthalenes to β-substituted monoalkylnaphthalenes being at least 1.0.

5. A lubricating oil composition according to claim 4 which further comprises at least one of a lubricating oil and a mineral oil, said mineral oil or lubricating oil being in the amount of 25–75% by weight.

6. A lubricating oil composition according to claim 4 which consists of:

19 mol % of α—(1-methylnonyl) naphthalene;
16 mol % of α—(1-ethyloctyl) naphthalene;
12 mol % of α—(1-propylheptyl) naphthalene;
10 mol % of α—(1-butylhexyl) naphthalene; and
12 mol % of β—(1-methylnonyl) naphthalene;
11 mol % of β—(1-ethyloctyl) naphthalene;
10 mol % of β—(1-propylheptyl) naphthalene;
10 mol % of β—(1-butylhexyl) naphthalene

7. A lubricating oil composition according to claim 4 which consists of:

29 mol % of α—(1-methylheptyl) naphthalene;
17 mol % of α—(1-ethylhexyl) naphthalene;
13 mol % of α—(1-propylpentyl) naphthalene; and
17 mol % of β—(1-methylheptyl) naphthalene;
12 mol % of β—(1-ethylhexyl) naphthalene;
12 mol % of β—(1-propylpentyl) naphthalene;

8. A lubricating oil composition according to claim 4 which consists of:

18 mol % of α—(1-methylpentadecyl) naphthalene;
10 mol % of α—(1-ethyltetradecyl) naphthalene;
7 mol % of α—(1-propyltridecyl) naphthalene;
5 mol % of α—(1-butyldodecyl) naphthalene;
22 mol % of α—(1-pentylundecyl) naphthalene,
α—(1-hexyldecyl) naphthalene,
α—(1-heptylnonyl) naphthalene;

and 12 mol % of β—(1-methylpentadecyl) naphthalene;
7 mol % of β—(1-ethyltetradecyl) naphthalene;
4 mol % of β—(1-propyltridecyl) naphthalene;
2 mol % of β—(1-butyldodecyl) naphthalene;
13 mol % of β—(1-pentylundecyl) naphthalene,
β—(1-hexyldecyl) naphthalene,
β—(1-heptylnonyl) naphthalene.

9. A method of improving the oxidation stability of a thermal medium oil which consists of using a composition consisting essentially of a mixture of monoalkylnaphthalenes represented by the following general formulae,

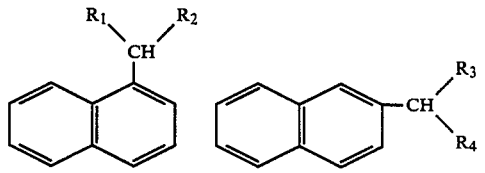

wherein $R_1$, $R_2$, $R_3$ and $R_4$ are each a straight-chain alkyl group and the total of the carbon atoms in $R_1$ and $R_2$ or in $R_3$ and $R_4$ is 5 to 23, and the molar ratio of $\alpha$-substituted monoalkylnaphthalenes to $\beta$-substituted monoalkylnaphthalenes being at least 1.0.

10. A method according to claim 9, wherein the said molar ratio is 1.0 to 2.0.

11. A method according to claim 9, wherein said total of the carbon atoms in $R_1$ and $R_2$ or in $R_3$ and $R_4$ is 7 to 13.

12. A thermal medium oil consisting essentially of a mixture of monoalkylnaphthalenes represented by the following general formulae,

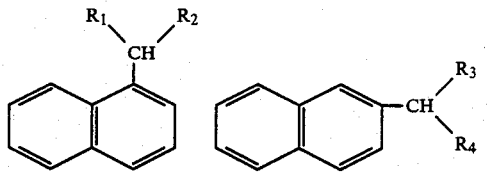

wherein $R_1$, $R_2$, $R_3$ and $R_4$ are each a straight-chain alkyl group and the total of the carbon atoms in $R_1$ and $R_2$ or in $R_3$ and $R_4$ is 5 to 23, and the molar ratio of $\alpha$-substituted monoalkylnaphthalenes to $\beta$-substituted monoalkylnaphthalenes being at least 1.0.

* * * * *